US010938184B2

(12) United States Patent
Kawata et al.

(10) Patent No.: US 10,938,184 B2
(45) Date of Patent: Mar. 2, 2021

(54) SPARK PLUG

(71) Applicant: DENSO CORPORATION, Kariya (JP)

(72) Inventors: Yuuki Kawata, Nisshin (JP); Masamichi Shibata, Kariya (JP); Kanechiyo Terada, Kariya (JP); Tetsuya Miwa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/931,782

(22) Filed: Jul. 17, 2020

(65) Prior Publication Data

US 2021/0021105 A1 Jan. 21, 2021

(30) Foreign Application Priority Data

Jul. 18, 2019 (JP) ..... JP2019-132573

(51) Int. Cl.
*H01T 13/32* (2006.01)
*H01T 13/20* (2006.01)
*H01T 13/34* (2006.01)

(52) U.S. Cl.
CPC ..... *H01T 13/32* (2013.01); *H01T 13/20* (2013.01); *H01T 13/34* (2013.01)

(58) Field of Classification Search
CPC ..... H01T 13/20; H01T 13/32; H01T 13/34; H01T 13/38
See application file for complete search history.

(56) References Cited

U.S. PATENT DOCUMENTS

2010/0206256 A1 8/2010 Kishimoto et al.
2012/0161605 A1 6/2012 Ban et al.
2019/0131776 A1* 5/2019 Isasa ..... H01T 13/14

FOREIGN PATENT DOCUMENTS

CN 204156288 U * 2/2015
EP 3 214 706 9/2017
JP 2013-143267 7/2013
JP 2016004730 A * 1/2016
WO WO-2012091920 A1 * 7/2012 ..... H01T 13/50

OTHER PUBLICATIONS

JP-2016004730-A English machine translation retrieved from Espacenet (Year: 2016).*

* cited by examiner

*Primary Examiner* — Mariceli Santiago
(74) *Attorney, Agent, or Firm* — Nixon & Vanderhye P.C.

(57) ABSTRACT

A spark plug has a housing, an insulator, a central electrode and a ground electrode. At least one projection part is formed on an outer peripheral surface of the insulator at a location facing a distal end cylindrical surface of the insulator in a radial direction of the spark plug so that at least one projection part has a minimum distance measured from a plug central axis of the spark plug, which is longer than a distance of another part of the insulator measured from the plug central axis. On a cross section of the spark plug, at least one projection part is formed on the outer peripheral surface of the insulator in a direction between at least one projection part and the plug central axis which crosses to a direction between a rod-shaped part and the plug central axis.

17 Claims, 13 Drawing Sheets

SPARK PLUG

CROSS-REFERENCE TO RELATED APPLICATION

This application is related to and claims priority from Japanese Patent Application No. 2019-132573 filed on Jul. 18, 2019, the contents of which are hereby incorporated by reference.

TECHNICAL FIELD

The present disclosure relates to spark plugs.

BACKGROUND

There is a spark plug having a structure which suppresses pre-ignition phenomenon from occurring. In the structure of the spark plug, a housing has a cylindrical distal end part which is exposed to the inside of a combustion chamber when the spark plug is mounted to an internal combustion engine. A penetration hole is formed in the cylindrical distal end part. An outer peripheral surface of the cylindrical distal end part communicates with an inner peripheral surface thereof through the penetration hole. The penetration hole is open toward a distal end part of an insulator in the spark plug so as to maintain a flow of a fuel mixture gas as a combustion gas which is flowing to the distal end part of the insulator through the penetration hole. This suppresses occurrence of such pre-ignition phenomenon caused by a high temperature at the distal end part of the insulator.

However, the structure of the spark plug previously described causes an incorrect phenomenon in which a fuel mixture gas remains in a pocket formed between the housing and the distal end part of the insulator. This fuel mixture gas remained in the pocket reaches a high temperature and causes pre-ignition phenomenon.

SUMMARY

It is desired for the present disclosure to provide a spark plug having a housing, an insulator, a central electrode and a ground electrode. The ground electrode has a rod-shaped part and an extension part. The rod-shaped part extends toward a distal end side of the spark plug from the housing in a spark plug axial direction of the spark plug. The extension part is arranged facing the central electrode in the spark plug axial direction. The insulator has a distal end cylindrical surface and at least one of projection parts. At least one of the projection parts is formed on an outer peripheral surface of the insulator at a location facing a distal end cylindrical surface of the insulator in a radial direction of the spark plug so that at least one of the projection parts has a minimum distance measured from a plug central axis of the spark plug, which is longer than a distance of another part of the insulator measured from the plug central axis. On a cross section of the spark plug perpendicular to the plug central axis, at least one of the projection parts is formed on the outer peripheral surface of the insulator in a direction between at least one of the projection parts and the plug central axis which crosses to a direction between the rod-shaped part and the plug central axis.

BRIEF DESCRIPTION OF THE DRAWINGS

A preferred, non-limiting embodiment of the present disclosure will be described by way of example with reference to the accompanying drawings, in which.

DETAILED DESCRIPTION OF THE PREFERRED EMBODIMENTS

Figure 1:
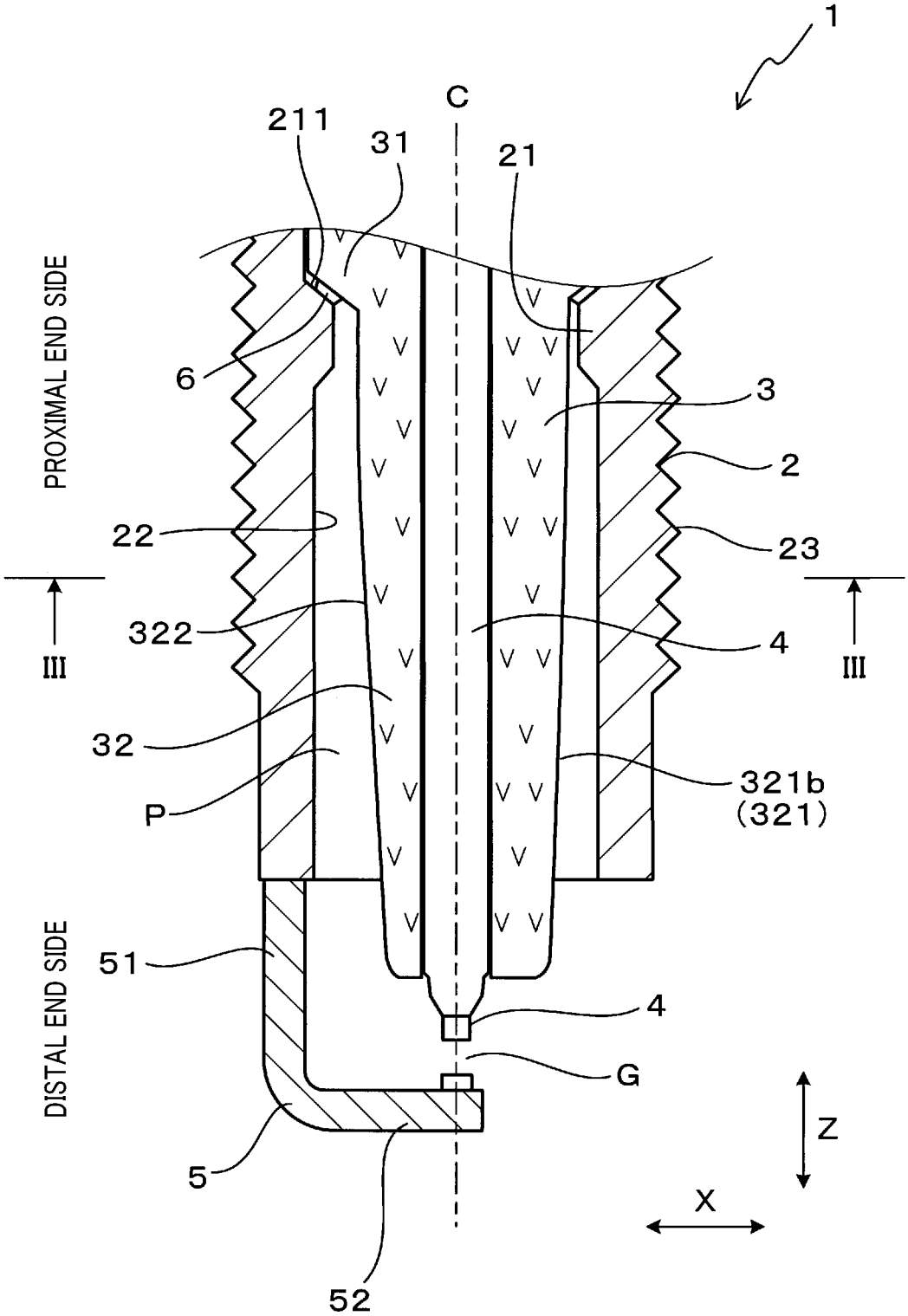
FIG. 1 is a view showing a cross section of a spark plug according to a first exemplary embodiment of the present disclosure, parallel with an axial direction of the spark plug.

Hereinafter, various embodiments of the present disclosure will be described with reference to the accompanying drawings. In the following description of the various embodiments, like reference characters or numerals designate like or equivalent component parts throughout the several diagrams.

First Exemplary Embodiment

A description will be given of a spark plug according to a first exemplary embodiment of the present disclosure with reference to FIG. 1 to FIG. 6.

Figure 2:
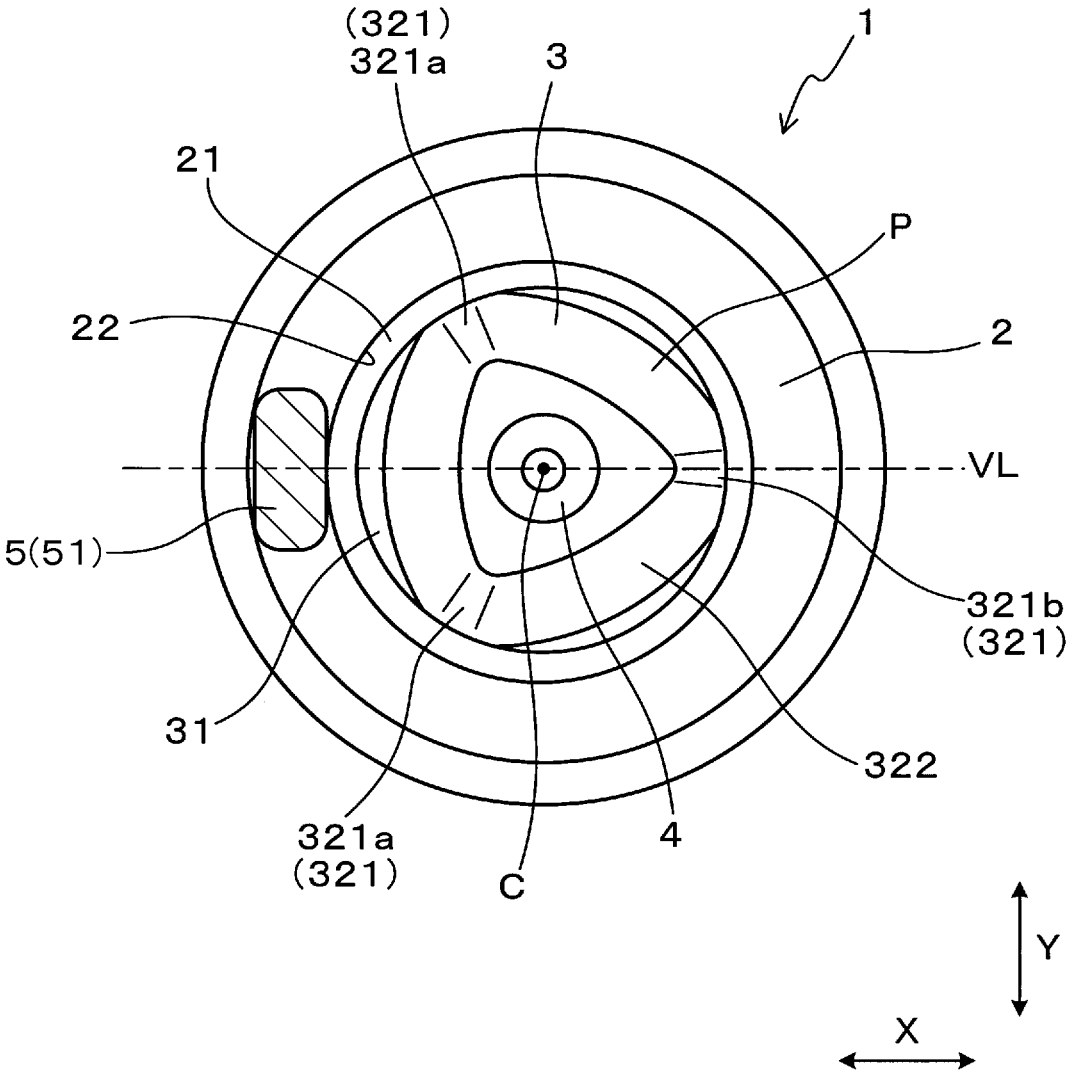
FIG. 2 is a view showing a cross section of a distal end of the spark plug according to the first exemplary embodiment shown in FIG. 1.

FIG. 1 is a view showing a cross section, parallel with an axial direction of the spark plug 1 according to the first exemplary embodiment. FIG. 2 is a view showing a cross section of a distal end of the spark plug 1 according to the first exemplary embodiment shown in FIG. 1. As shown in FIG. 1 and FIG. 2, the spark plug 1 according to the first exemplary embodiment has a housing 2, an insulator 3, a central electrode 4 and a ground electrode 5. The housing 2 has a cylindrical shape. The insulator 3 has a cylindrical shape and is supported by the inside of the housing 2. The central electrode 4 is arranged in the inside of the insulator 2 so that a distal end part of the central electrode 4 projects outside of the insulator 3. The ground electrode 5 is connected to the housing 2.

As shown in FIG. 1, the ground electrode 5 has a rod-shaped part 51 and an extension part 52. The rod-shaped part 51 extends from the housing 2 in a spark plug axial direction Z of the spark plug 1.

The extension part 52 is arranged facing the central electrode 4 in the spark plug axial direction Z, and has a curved shape which is curved from the rod-shaped part 51 inwardly in a radius direction of the spark plug 1.

The central electrode 4 and the extension part 52 of the ground electrode 5 form a discharge gap G (or a spark gap G).

Figure 3:
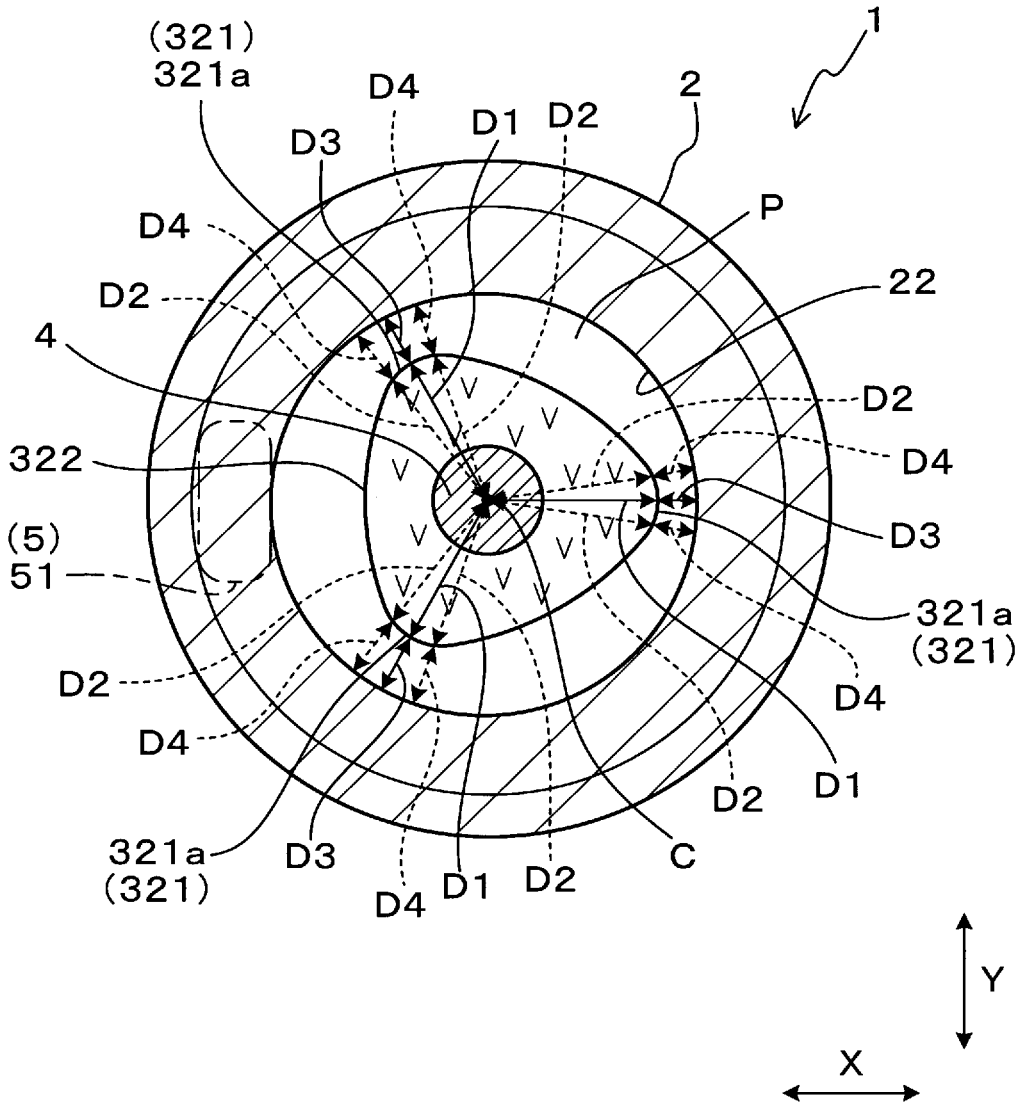
FIG. 3 is a view showing a cross section along the line III-III shown in FIG. 1.

FIG. 3 is a view showing a cross section along the line III-III shown in FIG. 1. As shown in FIG. 3, dash-dotted lines represent projection lines of an outline of the rod-shaped part 51 projected in the spark plug axial direction Z. As previously described, the extension part 52 has a curved shape which is curved from the rod-shaped part 51 inwardly in the radius direction of the spark plug 1. The surface of the extension part 52 of the ground electrode 5 and the surface of the distal end side of the central electrode 4 form the discharge gap G.

The housing 2 has a housing stopper part 21 projecting inwardly. The insulator 2 has an insulator stopper part 31 which is mated with the housing stopper part 21 of the housing 2 on a seat part 211 of the housing stopper part 21.

A distal end cylindrical surface 22 is formed from a distal end side of the housing stopper part 21 on the inner peripheral surface of the housing 2. At least one of projection parts 321 is formed on the outer peripheral surface 322 of the insulator 3 to face the distal end cylindrical surface 22 in the radial direction of the spark plug 1 so that the projection part 321 has a minimum distance D1 measured from a plug central axis C of the spark plug 1, which is longer than a distance of another part of the insulator 3 measured from the plug central axis C of the spark plug 1.

On a cross section of the spark plug perpendicular to the plug central axis, at least one of the projection parts 321 (e.g. at least a first projection part 321*a* which will be explained later) is formed on the outer peripheral surface of the insulator in a direction between at least one of the projection parts and the plug central axis which crosses to a direction (hereinafter, the direction X) between the rod-shaped part 51 and the plug central axis C.

A description will now be given of the structure and behavior of the spark plug 1 according to the first exemplary embodiment in detail.

It is possible to apply a spark plug as an ignition means to various types of internal combustion engines such as automobiles, co-generation systems, etc.

One terminal of the spark plug 1 is mounted to an ignition coil (not shown) and the other terminal of the spark plug 1 is arranged exposed to an inside of the combustion chamber of an internal combustion engine.

The plug central axis C is arranged along a center of the spark plug 1. The plug central axis C of the spark plug 1 is arranged parallel with the spark plug axial direction Z. The ignition coil (not shown) is electrically connected to the proximal end side of the spark plug 1 at the upper side in FIG. 1. The distal end side of the spark plug 1 is arranged at the bottom side in FIG. 1 to be exposed to the inside of the combustion chamber (not shown) of an internal combustion engine. The direction Y is perpendicular to the direction X and the spark plug axial direction Z.

The peripheral direction of the spark plug 1 will be referred to as the spark plug peripheral direction. The radial direction of the spark plug 1 will be referred to as the spark plug radial direction.

The housing 2 has a cylindrical shape made of heat-resistant metal material such as iron, nickel, iron-nickel alloy, stainless steel, etc. The housing 2 of the spark plug 1 is mounted on a plug hole formed in an internal combustion engine.

As shown in FIG. 1, a mounting screw part 23 is formed in the outer periphery at the distal end part of the housing 2.

Figure 4:
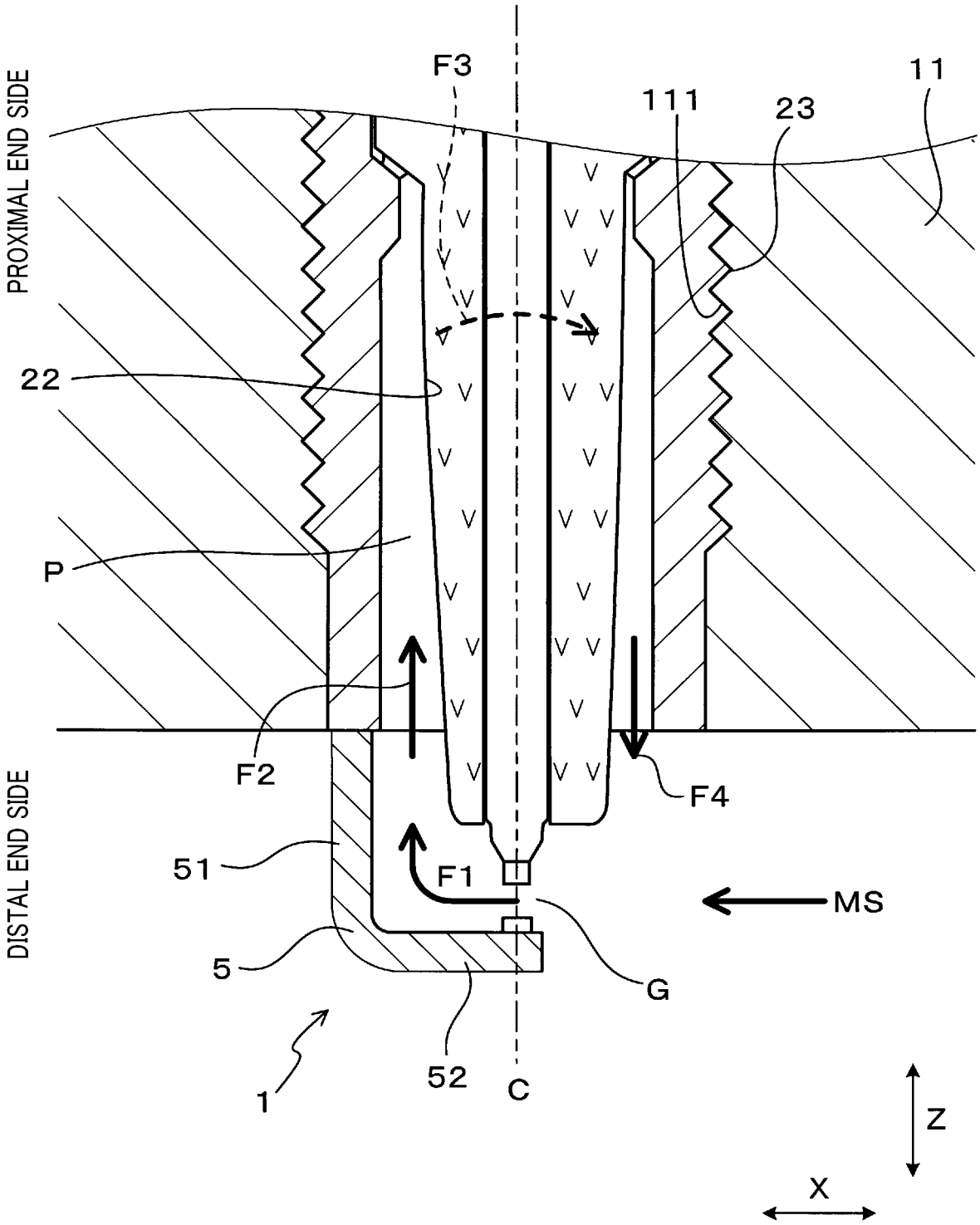
FIG. 4 is a view showing a cross section of an internal combustion engine equipped with the spark plug according to the first exemplary embodiment, which explains a flow of a fuel mixture gas (as a combustion gas) in a pocket formed in the spark plug.

FIG. 4 is a view showing a cross section of an internal combustion engine equipped with the spark plug 1 according to the first exemplary embodiment. FIG. 4 explains a flow of a fuel mixture gas (i.e. a combustion gas) in a pocket P formed in the spark plug 1.

As shown in FIG. 4, the mounting screw part 23 is mated with a female screw hole 111 formed in the plug hole of an engine head 11 of the internal combustion engine to which the spark plug 1 is mounted.

When the spark plug 1 is mated with the female screw hole 111 of the plug hole of the engine head 11, the spark plug 1 is fixed and mounted to the engine head 11 of the internal combustion engine. In this situation, the central electrode 4 and the ground electrode 5 at the distal end side of the spark plug 1 are exposed to the inside of the combustion chamber of the internal combustion engine.

As previously described, the distal end cylindrical surface 22 is formed at the front side of the housing stopper part 21 of the housing 2 on the inner peripheral surface of the housing 2. As shown in FIG. 1 to FIG. 3, the distal end cylindrical surface 22 is formed in a cylindrical shape. The distal end cylindrical surface 22 has the same inner diameter along the spark plug axial direction Z of the spark plug 1.

As shown in FIG. 1, the housing stopper part 21 is formed at a proximal end side of the distal end cylindrical surface 22 on the inner peripheral surface of the housing 2. The housing stopper part 21 of the housing 2 is a projection part of the inner peripheral surface of the housing 2, which projects inwardly from the main surface of the distal end cylindrical surface 22. The housing stopper part 21 is formed on the inner peripheral surface of the mounting screw part 23. Further, the mounting screw part 23 has a cylindrical shape and is formed around the inner peripheral surface of the housing 2.

The seat part 211 is a surface at a proximal end side of the housing stopper part 21 of the housing 2. The seat part 211 has a tapered shape so that the inner diameter thereof is reduced inwardly along the spark plug axial direction Z. The seat part 211 of the housing stopper part 21 is formed at the proximal end side of the housing stopper part 21 of the housing 2 around the overall circumferential direction thereof. That is, the seat part 211 of the housing stopper part 21 has a ring shape and supports and fixes the insulator 3 through a packing seal 6.

The insulator 3 has a cylindrical shape and is made of an insulation material such as alumina, etc. The insulator 3 is fixed by the housing 2 at the insulator stopper part 31 mated with the housing stopper part 21 of the housing 2 on the seat part 211 of the housing stopper part 21. The distal end part and the proximal end part of the insulator 3 project from the housing 2.

Similar to the seat part 211 previously described, the insulator stopper part 31 has a tapered shape so that the inner diameter thereof is reduced inwardly along the spark plug axial direction Z.

The insulator stopper part 31 is formed at the proximal end side of the insulator 3 around the overall circumferential direction thereof. That is, the insulator stopper part 31 of the insulator 3 has a ring shape so as to provide the sealing function between the housing stopper part 21 of the housing 2 and the insulator stopper part 31 of the insulator 3.

The packing seal 6 has a ring shape and is arranged between the seat part 211 and the insulator stopper part 31 so as to adhere both the seat part 211 and the insulator stopper part 31. That is, the gap formed between the seat part 211 and the insulator stopper part 31 is completely sealed by the packing seal 6 around the overall periphery thereof. The insulator 3 has an insulator leg part 32 formed at the distal end side of the insulator stopper part 31.

As shown in FIG. 1, the insulator leg part 32 has a structure in which an outer diameter thereof is reduced toward the distal end side of the insulator 3 along the spark plug axial direction Z. The distal end side of the insulator leg part 32 is exposed outside from the distal end part of the housing 2.

A cross section of the outer peripheral surface 322 of the insulator leg part 32 has a convex polygonal shape in a direction perpendicular to the spark plug axial direction Z has a convex polygonal shape. The outer peripheral surface 322 is arranged facing the distal end cylindrical surface 22 of the housing 2 in the spark plug radial direction.

In the structure of the spark plug 1 according to the first exemplary embodiment, the outer peripheral surface 322 has a cross section of a triangular shape as a convex polygonal cross section in a direction perpendicular to the spark plug axial direction Z.

That is, a convex polygonal shape has a structure in which each of interior angles thereof is less than 180°. The first exemplary embodiment allows the outer peripheral surface 322 of the insulator leg part 32 to have a cross section having various convex polygonal shapes, in which one side forming a convex polygonal shape has a curved shape, a corner of a convex polygonal shape has a rounded shape, and a combination thereof. That is, the first exemplary embodiment allows the outer peripheral surface 322 of the insulator leg part 32 to have various convex polygonal shapes (hereinafter, referred to as the leg part cross section. FIG. 3 shows one example of the leg part cross section of the outer peripheral surface 322 of the insulator leg part 32.

In the structure of the spark plug 1 according to the first exemplary embodiment shown in FIG. 3, the outer peripheral surface 322 of the insulator leg part 32 has a triangular cross section which is substantially a triangular shape. That is, each side of the triangular cross section of the outer peripheral surface 322 of the insulator leg part 32 has a curved shape which is expanded outward, and a top of each side has a rounded shape which smoothly connects the adjacent sides.

On a cross section of the outer peripheral surface 322 of the insulator leg part 32, in a direction perpendicular to the spark plug axial direction Z, three corner parts of the triangular shape of the outer peripheral surface 322 form three projection parts 321. That is, the outer peripheral surface of the insulator 3 has the three projection parts 321 formed at three points along the plug circumferential direction of the insulator 3. Each projection part 321 of the cross section of the outer peripheral surface 322 has a curved shape. Each projection part 321 is substantially formed in a curved shape on the overall insulator leg part 32. As previously described, the first minimum distance D1 measured between the projection part 321 and the plug central axis C of the spark plug 1 is greater than a second minimum distance D2 measured between the adjacent part of the projection part 321 and the plug central axis C of the spark plug 1. Accordingly, a third minimum distance D3 measured between the projection part 321 and the distal end cylindrical surface 22 is smaller than a fourth minimum distance D4 measured between the adjacent part of the projection part 321 and the distal end cylindrical surface 22.

As shown in FIG. 2, two projection parts 321*a* in the three projection parts 321 are arranged at both sides of a virtual straight line VL which connects between the plug central axis C and the rod-shaped part 51 of the ground electrode 5. The two projection parts 321*a* will be referred to as first projection parts 321*a*. The remaining projection part 321*b* in the three projection parts 321 will be referred to as a second projection part 321*b*. In this structure of the three projection parts 321, a direction which connects between each of the first projection parts 321*a* and the plug central axis C is oblique to the virtual straight line VL on a cross section of the outer peripheral surface 322 of the insulator leg part 32. In the structure of the spark plug 1 according to the first exemplary embodiment, the first projection parts 321*a* are arranged at an angle within a range of 30° to 150° viewed from a position of the rod-shaped part 51 on a cross section of the outer peripheral surface 322 of the insulator leg part 32.

When viewed from the spark plug axial direction Z, the second projection part 321*b* as the remaining projection part is arranged at a position which is opposite to the position of the rod-shaped part 51 on the virtual straight line VL.

As shown in FIG. 1, the pocket P is formed between the housing 2 and the insulator 3 in the radial direction of the spark plug 1. Both sides of the pocket P are open. As previously described, the distal end cylindrical surface 22 has the same inner diameter along the spark plug axial direction Z. On the other hand, the outer diameter of the insulator 3 is gradually reduced toward the distal end side thereof along the spark plug axial direction Z. Accordingly, the cross sectional area of the pocket P in the direction, which is perpendicular to the spark plug axial direction Z, between the distal end cylindrical surface 22 of the housing 2 and the insulator leg part 32 is gradually reduced along the proximal end side of the spark plug 1.

In the structure of the spark plug 1 according to the first exemplary embodiment, the distal end cylindrical surface 22 of the housing 2 has a cylindrical shape. As previously described, on the cross section of the insulator leg part 32, the outer peripheral surface 322 of the insulator leg part 32 of the insulator 3 has a triangular shape.

As shown in FIG. 3, the pocket P has the minimum dimension in the spark plug radial direction has the minimum value at the projection parts 321 of the insulator leg part 32.

As shown in FIG. 1, the central electrode 4 is arranged in the inside of the insulator 3. The central electrode 4 is made of conductor such as a Ni base alloy. The central electrode 4 has a cylindrical shape. A metal material having a superior conductivity such as Cu is arranged in the inside of the central electrode 4. The central electrode 4 is arranged at the distal end side of the insulator 3 and supported by the insulator 3. The distal end side of the central electrode 4 is projected from the insulator 3 in the spark plug axial direction Z.

The ground electrode 5 is connected to the distal end surface of the housing 2. The discharge gap G (or the spark gap G) is formed between the ground electrode 5 and the central electrode 4.

As previously described, the ground electrode 5 has the rod-shaped part 51 and the extension part 52. The rod-shaped part 51 extends from the housing 2 in the spark plug axial direction Z of the spark plug 1. The extension part 52 faces the central electrode 4 in the spark plug axial direction Z, and has a curved shape which is curved from the rod-shaped part 51 inwardly in a radius direction of the spark plug 1. A part of the extension part 52 of the ground electrode 5 is arranged facing the distal end surface of the central electrode 4. As previously described, the discharge gap G is formed between the surface of the distal end side of the central electrode 4 and the ground electrode 5 in the spark plug axial direction Z.

A fuel mixture gas introduced in the combustion chamber is ignited by the generation of a spark discharge in the discharge gap G.

As shown in FIG. 4, the spark plug 1 is mounted to an internal combustion engine. The fuel mixture gas flows around the distal end part of the spark plug 1. The spark plug 1 is arranged so that the downstream side of a main stream MS of the fuel mixture gas is arranged at the rod-shaped part 51 side of the ground electrode 5. This arrangement of the spark plug 1 in the internal combustion engine allows the main stream MS of the fuel mixture gas to be easily guided and introduced into the pocket P of the spark plug 1 because the main stream MS of the fuel mixture gas collides with the rod-shaped part 51 of the ground electrode 5.

It is known that this arrangement of the spark plug 1 in the internal combustion engine previously described easily generates a stagnant state of the fuel mixture gas in the pocket P. Pre-ignition phenomenon, incomplete combustion phenomenon, etc. easily occur due to the stagnant state of the fuel mixture gas. Such incomplete combustion causes a phenomenon of adhesion of carbon in the spark plug 1 and accumulation of carbon on the spark plug 1.

On the other hand, the spark plug 1 according to the first exemplary embodiment has the first projection part 311*a* on the insulator leg part 32 of the insulator 3. The formation of the first projection part 311*a* allows the fuel mixture gas in the pocket P to be discharged outside.

It is possible to align the flow direction of the main stream MS of the fuel mixture gas with the arrangement direction of an intake valve (not shown) and an exhaust valve of the internal combustion engine, to which the spark plug 1 according to the first exemplary embodiment is mounted. It is possible to adjust the plug circumferential direction of the spark plug 1 mounted to the internal combustion engine by adjusting the formation direction of the mounting screw part 23 formed in the outer periphery at the distal end part of the housing 2. Further, it is possible to adjust the plug circumferential direction of the spark plug 1 mounted to the internal combustion engine by adjusting the mating position of the spark plug 1 to the engine head 11 when a spacer or a gasket is arranged between the engine head 11 and the housing 2 at the distal end side of the mounting screw part 23.

A description will now be given of the behavior and effects of the spark plug 1 according to the first exemplary embodiment.

The outer peripheral surface of the insulator 3 has at least one of the projection parts 321 formed at a location which faces the distal end cylindrical surface 22 in the radial direction of the spark plug 1 so that the projection part 321 has the minimum distance D1, measured from the plug central axis C of the spark plug 1, which is longer than the distance of other parts of the insulator 3 measured from the plug central axis C of the spark plug 1.

That is, on a cross section of the spark plug 1 perpendicular to the plug central axis C, at least one of the projection parts 321 (e.g. the first projection part 321*a*) is formed on the outer peripheral surface of the insulator 3 in a direction between at least one of the projection parts and the plug central axis C, which crosses to a direction between the rod-shaped part 31 and the plug central axis C.

Accordingly, at least one of the projection parts 321 (i.e. the first projection parts 321*a* and the second projection part 321*b*) throttles the main stream MS of the fuel mixture gas flowing in the plug circumferential direction in the pocket P.

This structure makes it possible for the fuel mixture gas to flow at a necessary flow speed in the pocket P. Further, this structure makes it possible to prevent the fuel mixture gas from remaining in the pocket P, and to promote the fuel mixture gas from being exhausted outside. As a result, this structure of the spark plug 1 makes it possible to suppress pre-ignition of the fuel mixture gas from being caused in the pocket P due to increasing the temperature of the fuel mixture gas remaining in the pocket P. A description will now be given of the explanation why this phenomenon occurs.

Figure 5:
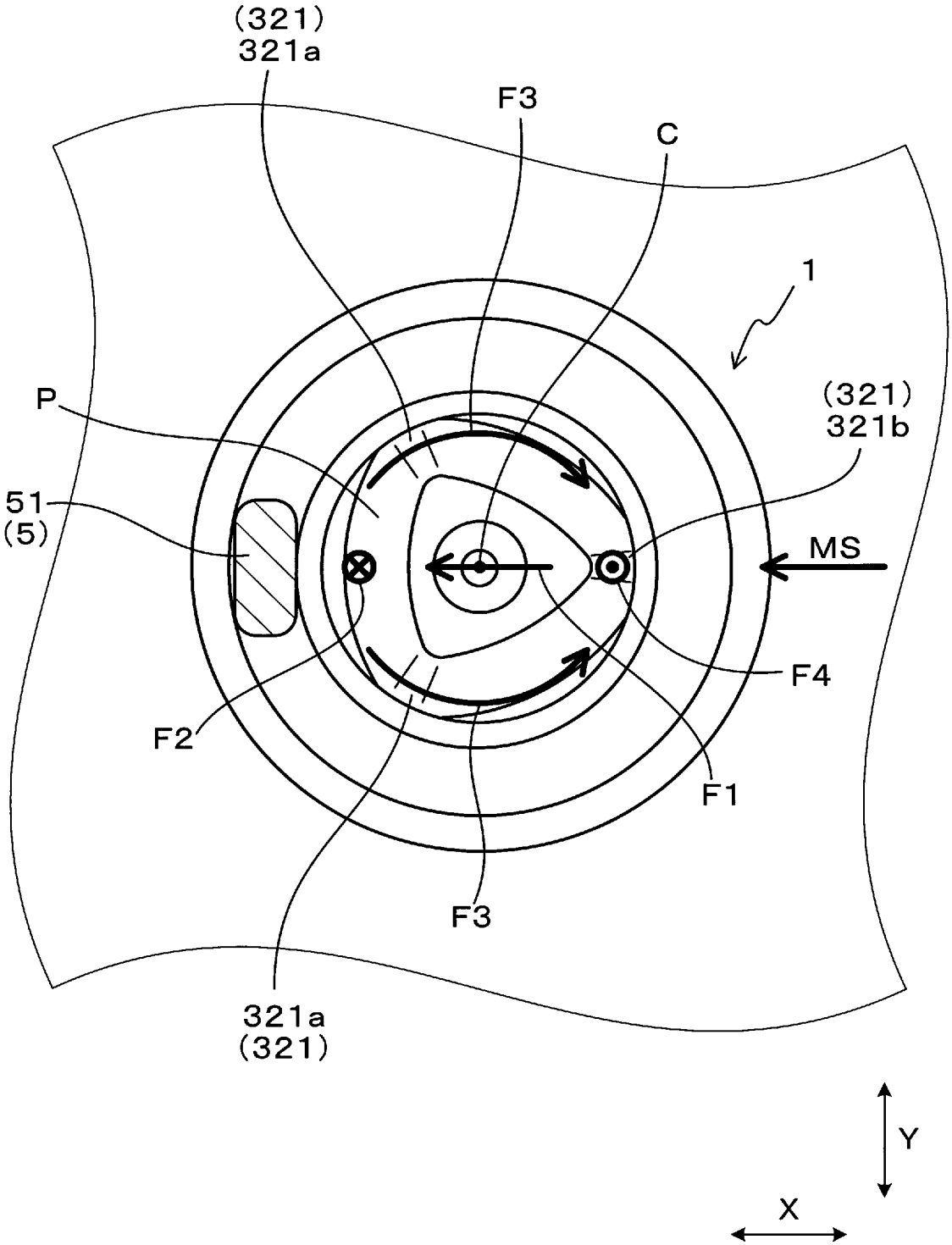
FIG. 5 is a view showing a cross section of the distal end of the internal combustion engine equipped with the spark plug according to the first exemplary embodiment, and showing an explanation of the flow direction of the fuel mixture gas in a pocket formed in the inside of the spark plug.

FIG. 5 is a view showing a cross section of the distal end of the internal combustion engine equipped with the spark plug 1 according to the first exemplary embodiment. That is, FIG. 5 shows the explanation of the flow direction of the fuel mixture gas in the pocket P formed between the housing 2 and the insulator 3 in the radial direction of the spark plug 1.

As shown in FIG. 4 and FIG. 5, when the fuel mixture gas is flowing in the direction X, and the spark plug 1 is mounted to the internal combustion engine so that the rod-shaped part 51 side of the ground electrode 5 is arranged at the downstream side of the main stream MS of the fuel mixture gas, viewed from the central axis C of the spark plug 1, the gas stream F of the fuel mixture gas flowing around the discharge gap G in the direction X collides with the rod-shaped part 51 of the ground electrode 5. In this case, the main stream MS of the fuel mixture gas is guided by the rod-shaped part 51 along the spark plug axial direction Z, and enters into the inside of the pocket P through the opening of the pocket P. The gas flow F2 of the fuel mixture gas entered into the inside of the pocket P is flowing toward the back of the pocket P in the direction Z.

The pocket P is formed so that the area of the cross section of the pocket P in the direction perpendicular to the spark plug axial direction Z is gradually reduced toward the proximal end side of the spark plug 1. Accordingly, the gas flow F2 of the fuel mixture gas is curved in the plug circumferential direction at the back of the pocket P (i.e. at the proximal end side of the pocket P in the spark plug axial direction Z), the fuel mixture gas flows in both of the plug circumferential direction.

Figure 6:
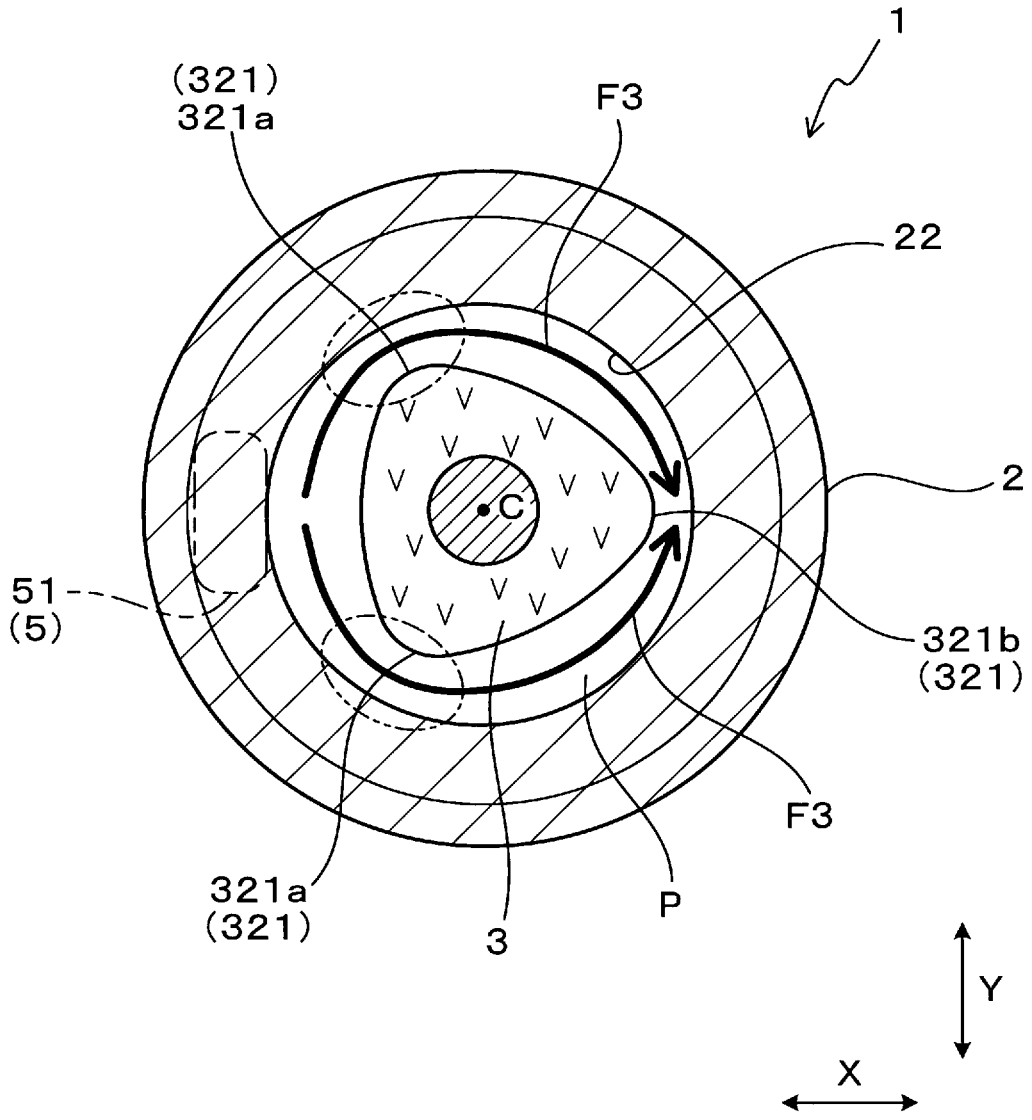
FIG. 6 is a view showing a cross section of the internal combustion engine equipped with the spark plug according to the first exemplary embodiment, in a direction perpendicular to a spark plug axial direction so as to explain the flow of the fuel mixture gas along a circumferential direction of the pocket formed in the spark plug.

FIG. 6 is a view showing a cross section of the internal combustion engine equipped with the spark plug 1 according to the first exemplary embodiment, in a direction perpendicular to the spark plug axial direction Z. FIG. 6 explains the flow of the fuel mixture gas along the circumferential direction of the pocket P formed in the spark plug 1. As shown in FIG. 5 and FIG. 6, a specific area, designated by the dash-dotted lines, formed between the first projection part 321*a* and the distal end cylindrical surface 22 of the housing 2 is relatively smaller than the remaining area in the pocket P. This improved structure makes it possible to throttle the flow of the fuel mixture gas and to increase the flow speed of the fuel mixture gas flowing in the pocket P around the circumferential direction of the insulator 3. This behavior maintains the flow speed of the fuel mixture gas in the pocket P, and suppresses the fuel mixture gas from remaining at the back of the pocket P.

The gas flow F3 of the fuel mixture gas around the plug circumferential direction in the pocket P collides with each other at the area opposite to the location of the rod-shaped part 51 projected in the spark plug axial direction Z around the plug central axis C. As shown in FIG. 4 and FIG. 5, the gas flow F3 of the fuel mixture gas is curved in the spark plug axial direction Z toward the opening of the pocket P. The curved gas flow F4 is exhausted outside from the opening of the pocket P.

As previously described, the improved structure of the spark plug 1 according to the first exemplary embodiment makes it possible to keep the necessary flow speed of the fuel mixture gas in the pocket P, and to prevent the fuel mixture gas from remaining in the pocket P, and to promote exhaust of the fuel mixture gas from the pocket P.

As previously described, the outer peripheral surface 322 is arranged facing the distal end cylindrical surface 22 of the housing 2 in the spark plug radial direction. In the improved structure of the spark plug 1 according to the first exemplary embodiment, a cross section of the outer peripheral surface 322 of the insulator leg part 32 has a convex polygonal shape in a direction perpendicular to the spark plug axial direction Z has a convex polygonal shape.

This structure makes it possible to easily form the projection part 321 without forming a complicated structure of the spark plug.

Further, in the improved structure of the spark plug 1 according to the first exemplary embodiment, a cross section, in a direction which is perpendicular to the spark plug axial direction Z, of the projection part 321 of the insulator 3 has a curved line. This structure makes it possible to suppress occurrence of disturbance of the gas flow of the fuel mixture gas flowing around the projection parts 321 of the insulator 3 in the pocket P along the plug circumferential direction.

As previously described in detail, the first exemplary embodiment provides the spark plug 1 having the improved structure capable of suppressing pre-ignition from occurring in the pocket P formed in the spark plug 1.

Experimental Results

A description will be given of the experiment and the experimental results with reference to FIG. 7 and FIG. 8.

Figure 7:
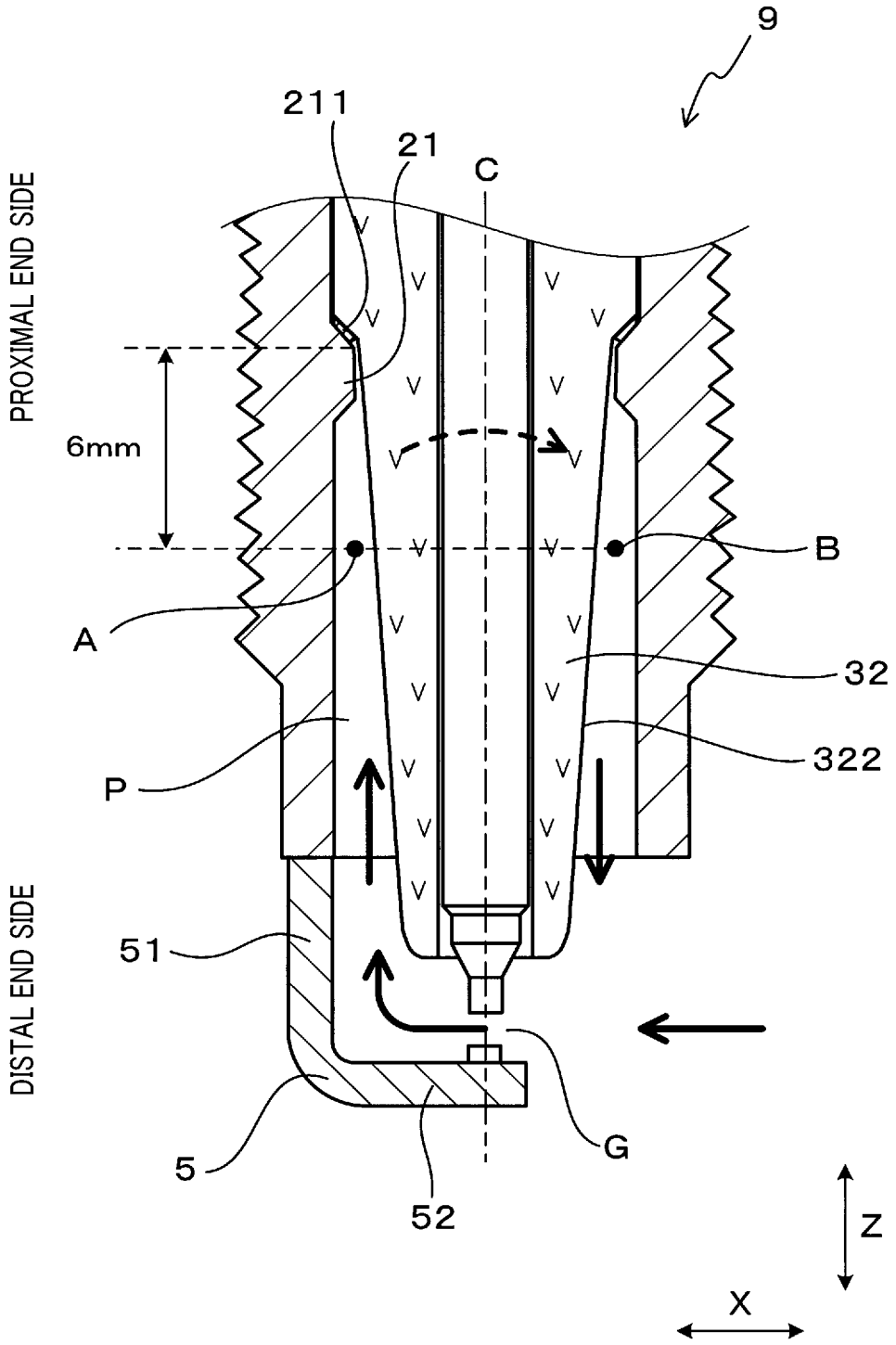
FIG. 7 is a view showing a cross section perpendicular to an axial direction of a spark plug according to a comparative test sample used in an experiment.

FIG. 7 is a view showing a cross section perpendicular to a spark plug axial direction in a spark plug 9 according to a comparative sample used in an experiment. FIG. 8 is a graph showing experimental results of a flow speed of a fuel mixture gas at a first measurement point and a second measurement point of a first test sample and a comparative sample used in the experiment.

The experiment used a test sample having the same structure of the spark plug 1 according to the first exemplary embodiment. The experiment further used a comparative sample having the same structure of the spark plug 9 shown in FIG. 7. That is, as shown in FIG. 7, the comparative sample as the spark plug 9 has the structure in which a cross section of the pocket P has a circular shape. The pocket P is formed between the outer peripheral surface of the insulator leg part 32 of the insulator 3 and the inner peripheral surface of the housing 2 on a cross section perpendicular to the spark plug axial direction Z.

The experiment performed a simulation regarding a flow speed of the flow of the fuel mixture gas in the pocket P of each of the test sample and the comparative sample.

The comparative sample shown in FIG. 7 has the structure in which the outer diameter of the insulator leg part 32 of the insulator 3 is gradually reduced toward the distal end side of the spark plug 9. The other components of the spark plug 9 as the comparative sample have the same structure of those of the spark plug 1 according to the first exemplary embodiment as the test sample.

Hereinafter, the same components between the test sample and the comparative sample will be referred with the same reference numbers and characters.

The experiment detected a flow speed of the fuel mixture gas flowing in the pocket P when the fuel mixture gas was supplied around the distal end part of each of the test sample and the comparative sample under the situation in which the rod-shaped part 51 of the insulator 5 of in each of the test sample and the comparative sample was arranged at the downstream side of the flow of the fuel mixture gas viewed from the plug central axis C.

The experiment detected the flow speed of the fuel mixture gas at the first measurement point A and the second measurement point B in the pocket P in each of the test sample and the comparative sample. As shown in FIG. 7, the first measurement point A was located at the position of the rod-shaped part 51 side in the pocket P along the plug circumferential direction. On the other hand, the second measurement point B was located at the position opposite to the first measurement point A in the pocket P along the plug circumferential direction As shown in FIG. 7, the first measurement point A and the second measurement point B were arranged symmetry about the axis of the plug central axis C of the spark plug 1. That is, the first measurement point A was separated from the second measurement point B in the plug circumferential direction by 180°.

Each of the first measurement point A and the second measurement point B was located in the pocket P and separated from the seat part 211 of the housing stopper part 21 by 6 mm length in the spark plug axial direction Z.

The experiment detected a flow speed of the fuel mixture gas at each of the first measurement point A and the second measurement point B in each of the test sample (see FIG. 1 to FIG. 6) and the comparative sample (see FIG. 7) at the Before Top Dead Center (BTDC) when a crank angle of the crank in the internal combustion engine was 50°. FIG. 8 shows the experimental results. In the graph shown in FIG. 8, when the flow speed of the fuel mixture gas in the proximal end side (in the direction toward the back side of the pocket P) of the spark plug 1 in the spark plug axial direction Z has a positive value, the flow speed of the fuel mixture gas toward the distal end side of the spark plug 1 has a negative value.

Figure 8:
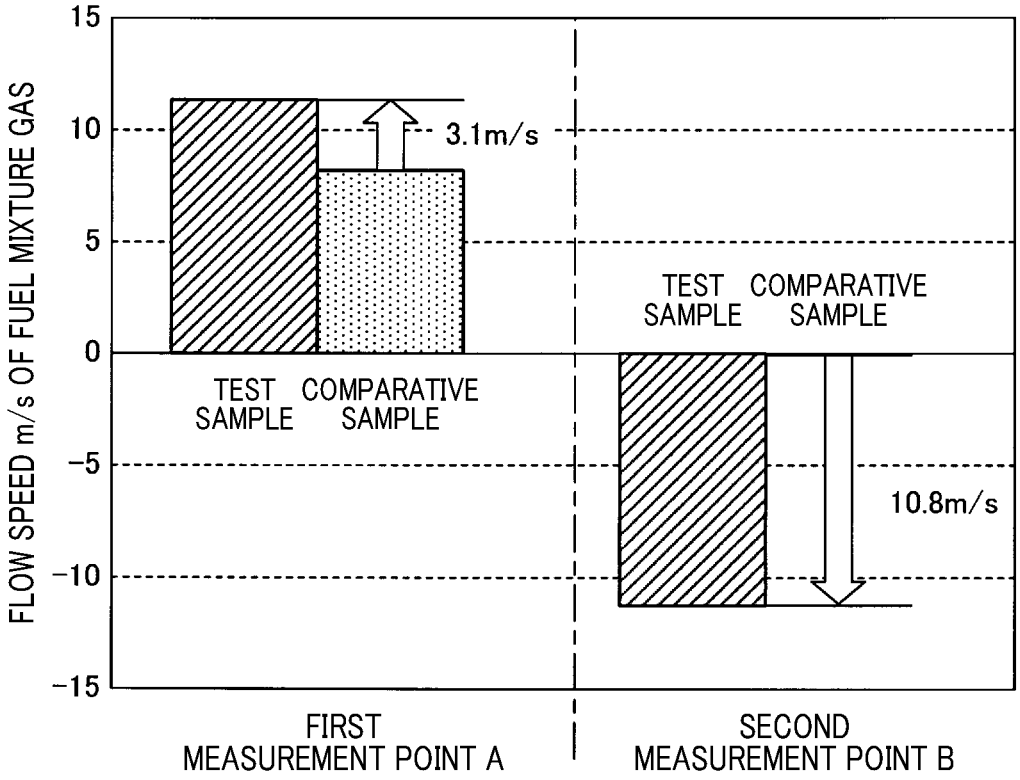
FIG. 8 is a graph showing experimental results of a flow speed of a fuel mixture gas at a first measurement point and a second measurement point of a first test sample and a comparative test sample used in the experiment.

As can be clearly understood from the experimental results shown in FIG. 8, the test sample had the flow speed at the first measurement point A which was higher by 3.1 m/s than the flow speed of the comparative sample at the first measurement point A. Further, the test sample had the flow speed at the second measurement point B which was higher by 10.8 m/s than the flow speed of the comparative sample at the second measurement point B. In other words, a difference in the flow speed at the first measurement point A between the test sample and the comparative sample was 3.1 m/s, and a difference in the flow speed at the second measurement point B between the test sample and the comparative sample was 10.8 m/s.

The test sample having the same structure of the spark plug 1 according to the first exemplary embodiment has an increased flow speed at each of the first measurement point A and the second measurement point B more than the flow speed of the comparative sample.

On the basis of the experimental results shown in FIG. 8, it can be considered that the test sample has the increased flow speed of the fuel mixture gas in the pocket P at the first measurement point A and the second measurement point B because the structure of the test sample as the spark plug 1 does not reduce and keeps the flow speed of the fuel mixture gas in the plug circumferential direction in the pocket P.

Second Exemplary Embodiment

A description will be given of the spark plug according to a second exemplary embodiment of the present disclosure with reference to FIG. 9 to FIG. 11.

Figure 9:
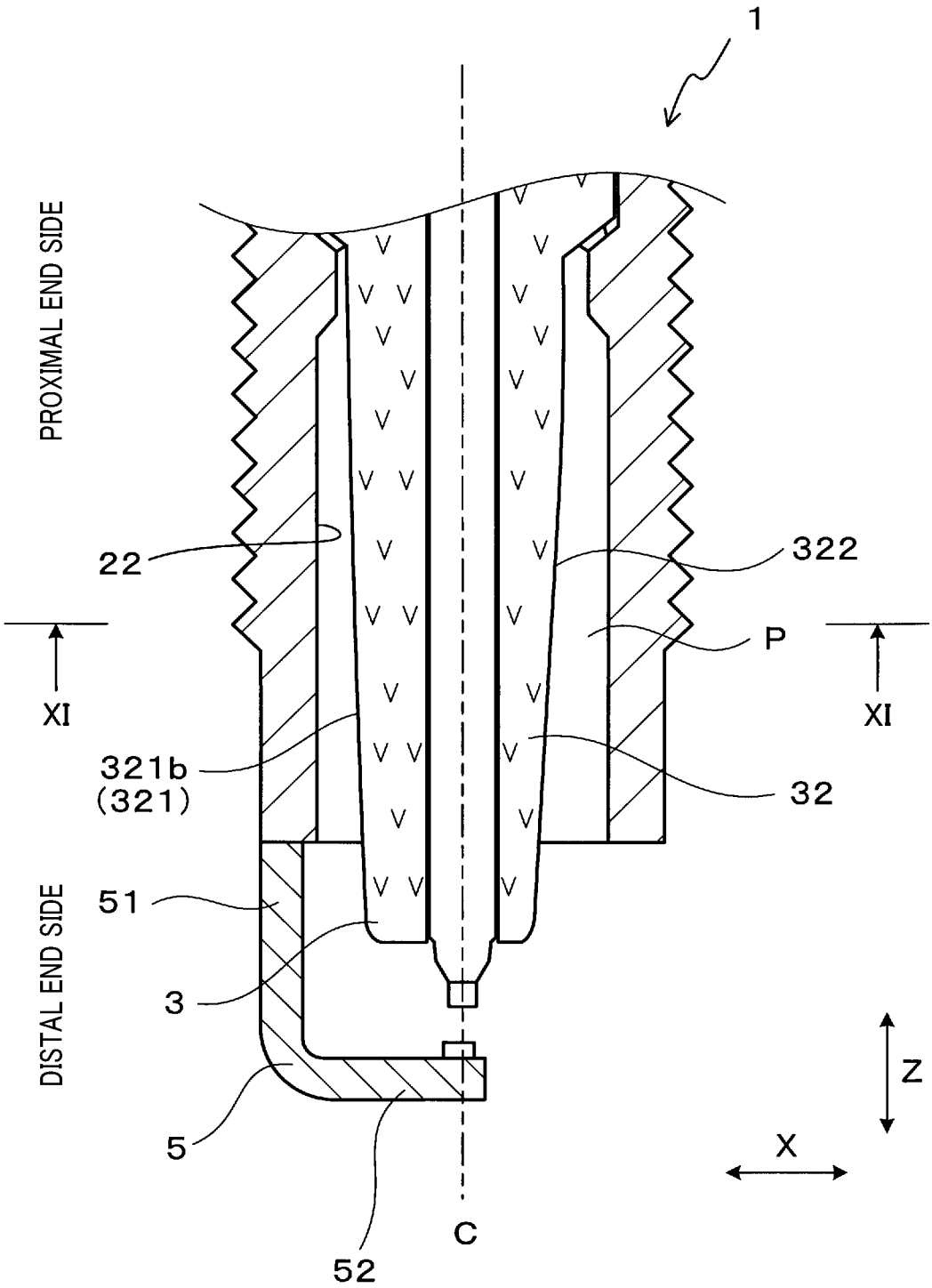
FIG. 9 is a view showing a cross section parallel with the axial direction of the spark plug according to a second exemplary embodiment of the present disclosure.

FIG. 9 is a view showing a cross section parallel with the axial direction of the spark plug 1 according to the second exemplary embodiment. FIG. 10 is a view showing a distal end side of the spark plug 1 according to the second exemplary embodiment. FIG. 11 is a view showing a cross section along the line XI-XI shown in FIG. 9.

Figure 11:
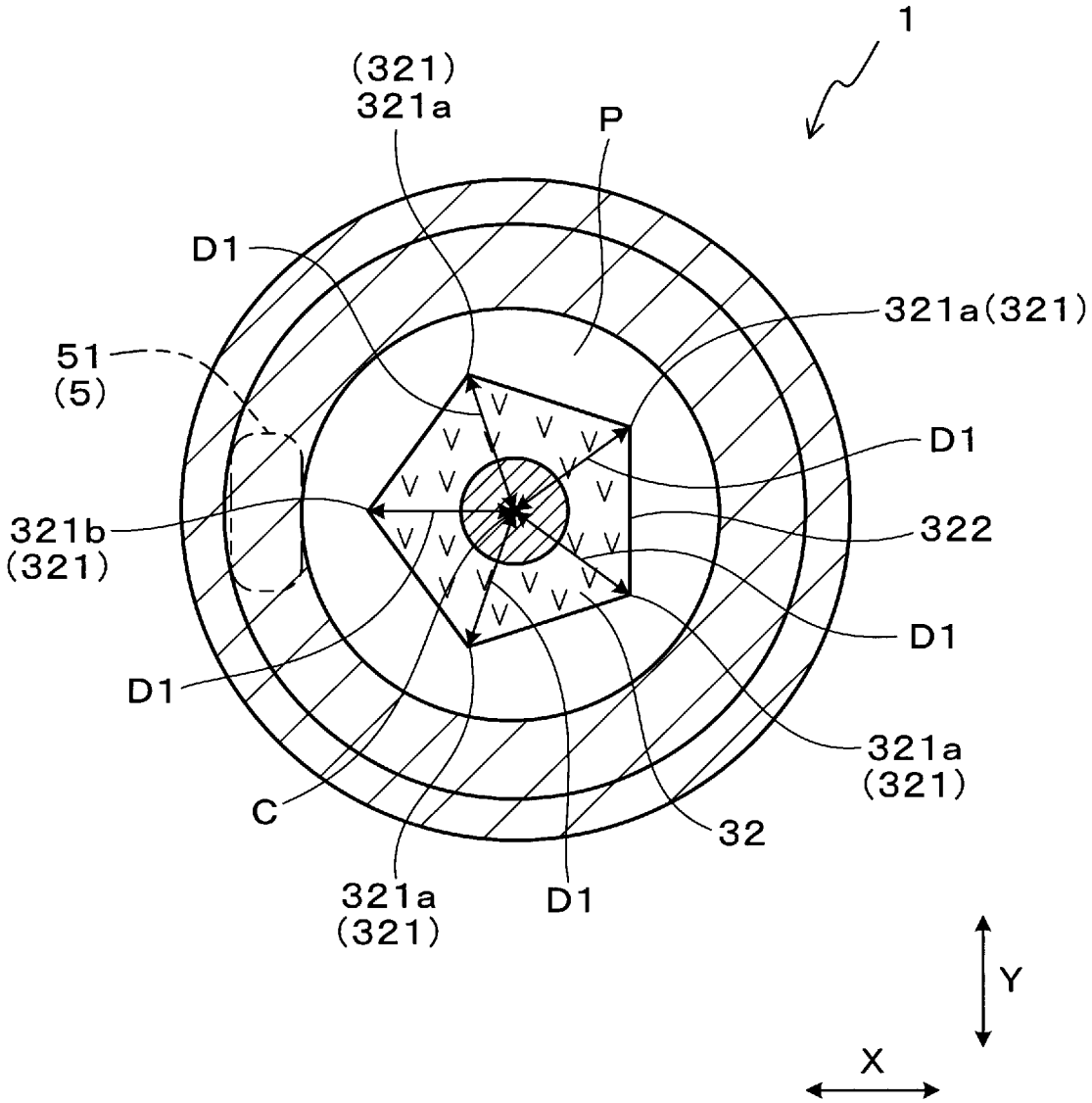
FIG. 11 is a view showing a cross section along the line XI-XI shown in FIG. 9.

As shown in FIG. 11, the spark plug 1 according to the second exemplary embodiment has the improved structure in which the cross section, in a direction perpendicular to the spark plug axial direction Z, of the outer peripheral surface 322 of the insulator leg part 32 of the insulator 3 has a pentagonal shape. Other components of the spark plug 1 according to the second exemplary embodiment are the same of those of the spark plug 1 according to the first exemplary embodiment. The explanation of the same components is omitted here for brevity.

As shown in FIG. 11, a cross section of the outer peripheral surface 322 in a direction which is perpendicular to the spark plug axial direction Z has a pentagonal shape, and has five projection parts 321 at the corner parts of its pentagonal shape. The five projection parts of the outer peripheral surface 322 of the insulator leg part 32 of the insulator 3 are composed of the four projection parts 321*a* and one projection part 321*b*. That is, the outer peripheral surface 322 of the insulator leg part 32 has the five projection parts 321 around the plug circumferential direction. It is acceptable for the outer peripheral surface 322 to have another structure in which each of the five sides forming the pentagonal shape has a curved shape, and or each of the five corner parts of the pentagonal shape has a rounded shape.

Figure 10:
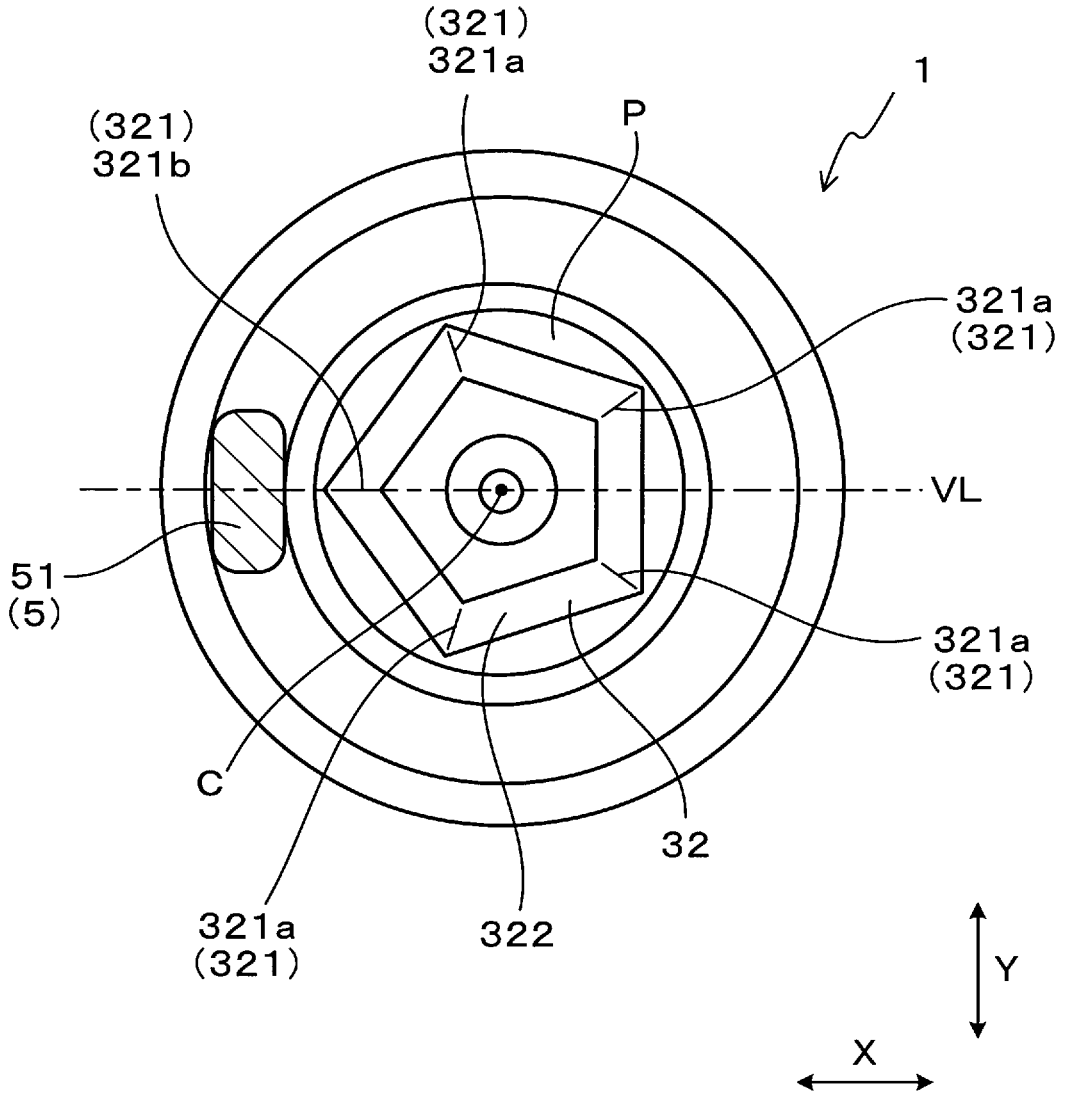
FIG. 10 is a view showing a distal end of the spark plug according to the second exemplary embodiment.

As shown in FIG. 10, the four projection parts 321*a* in the five projection parts 321 are arranged every pairs thereof at both sides of a virtual straight line VL which connects between the plug central axis C and the rod-shaped part 51 of the ground electrode 5. The two pairs of the projection parts 321*a* will be referred to as a first pair and a second pair of the projection parts 321*a*. In this structure of the four projection parts 321 forming the first pair and the second pair, a direction which connects between the first pair of the first projection parts 321*a* and the plug central axis C is oblique to the virtual straight line VL, and a direction which connects between the second pair of the first projection parts 321*a* and the plug central axis C is oblique to the virtual straight line VL on a cross section of the outer peripheral surface 322 of the insulator leg part 32. Other components of the spark plug according to the second exemplary embodiment are the same as those of the spark plug 1 according to the first exemplary embodiment. The explanation of the same components is omitted here for brevity.

The spark plug 1 according to the second exemplary embodiment having the improved structure previously described has the same behavior and effects of the spark plug 1 according to the first exemplary embodiment.

Third Exemplary Embodiment

A description will be given of the spark plug according to a third exemplary embodiment of the present disclosure with reference to FIG. 12 and FIG. 13.

Figure 12:
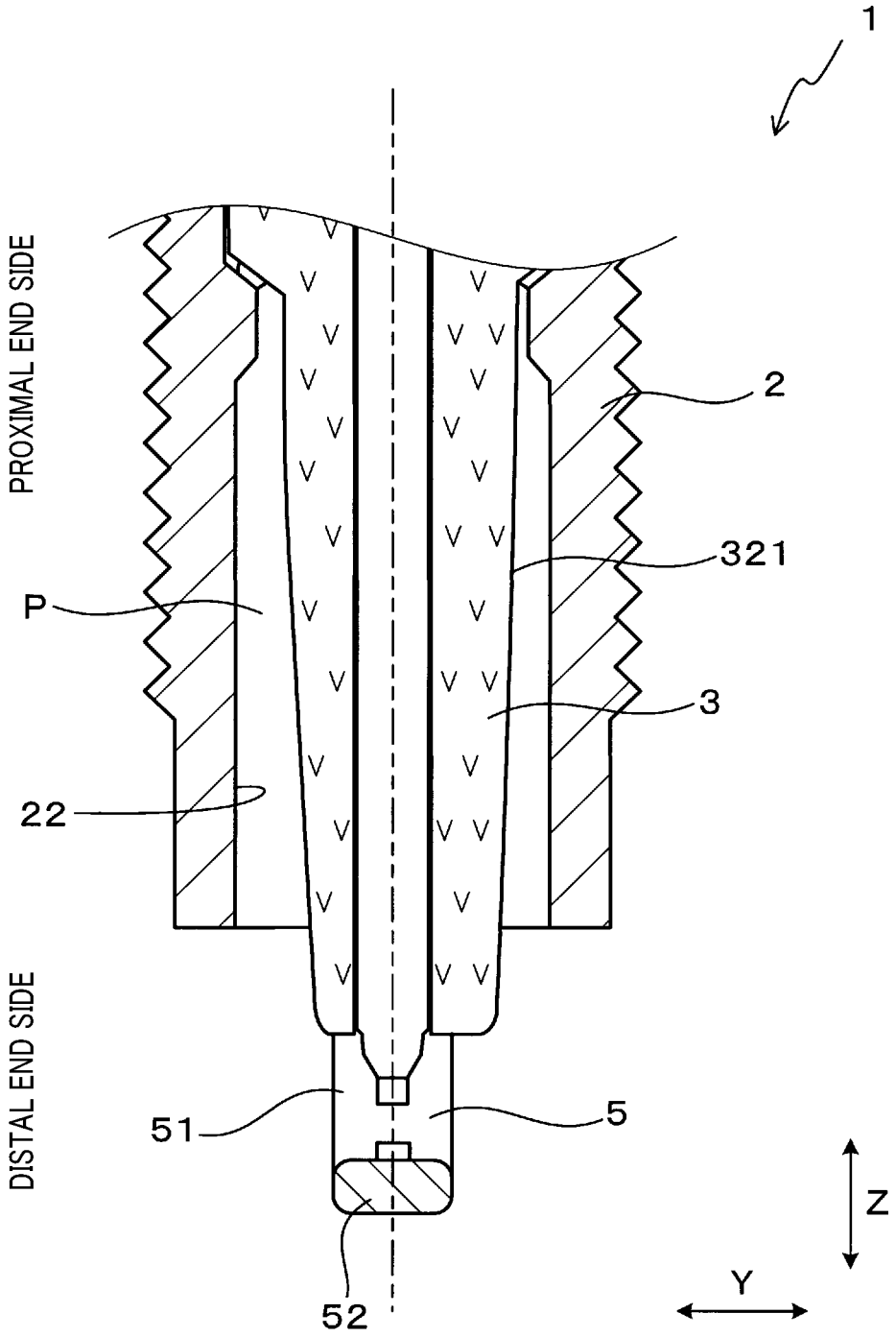
FIG. 12 is a view showing a cross section parallel with the axial direction of the spark plug according to a third exemplary embodiment of the present disclosure.

FIG. 12 is a view showing a cross section parallel with the axial direction of the spark plug 1 according to the third exemplary embodiment. FIG. 13 is a view showing a distal end of the spark plug 1 according to the third exemplary embodiment. As shown in FIG. 12 and FIG. 13, in the spark plug 1 according to the third exemplary embodiment, the insulator 3 is arranged at a location in the plug circumferential direction which is different from the location of the insulator 3 in the spark plug 1 according to the first and second exemplary embodiments.

Figure 13:
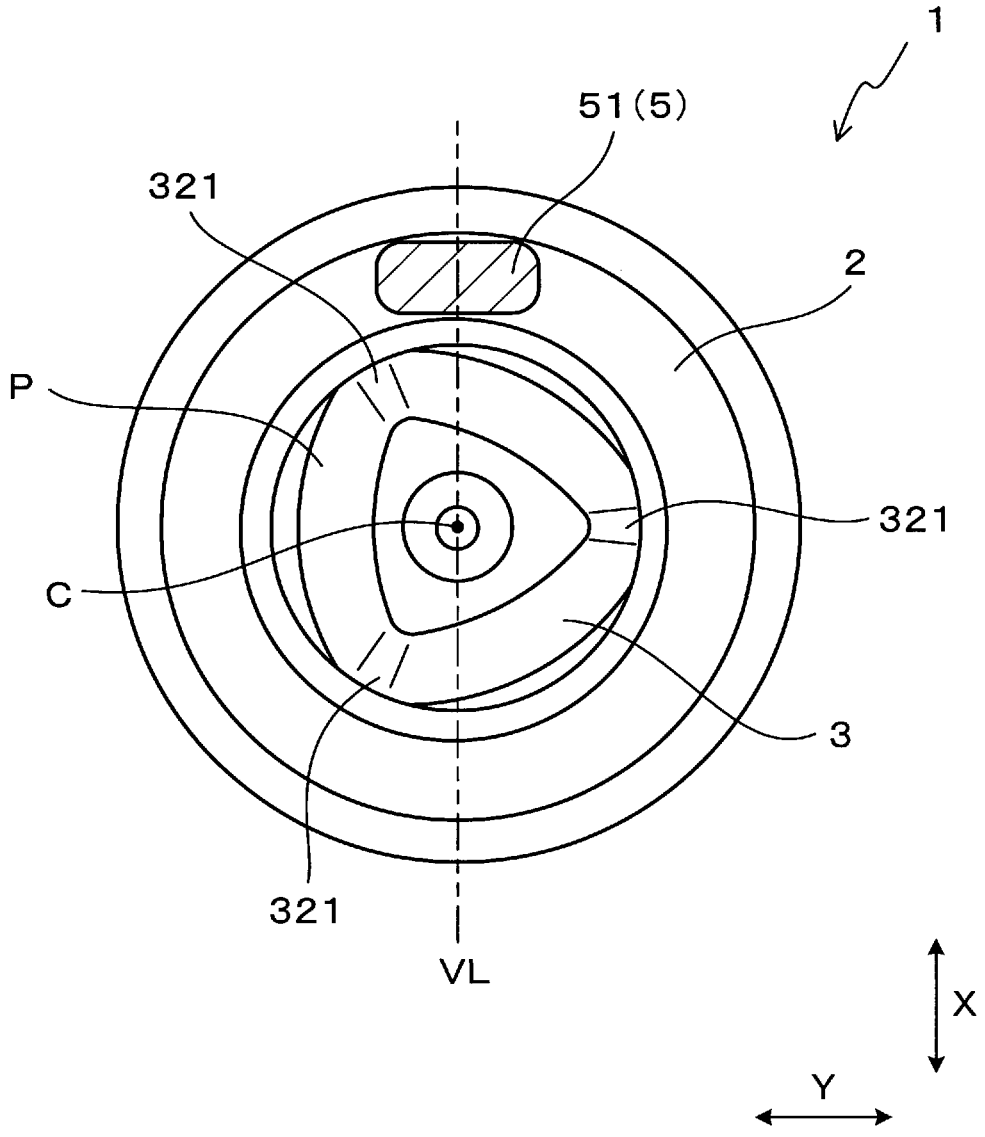
FIG. 13 is a view showing a distal end of the spark plug according to the third exemplary embodiment.

As show in FIG. 13, the two projection parts 321 in the three projection parts 321 are arranged at one side in the direction Y viewed from the virtual straight line VL, where the virtual straight line VL connects between the plug central axis C and the rod-shaped part 51 of the ground electrode 5. The remaining projection part 321 in the three projection parts 321 is arranged at the other side in the direction Y viewed from the virtual straight line VL. The virtual straight line VL is located perpendicular to the straight line which connects between the plug central axis C and the remaining projection part 321 arranged at the other side in the direction Y.

Other components of the spark plug 1 according to the third exemplary embodiment are the same of those of the spark plug 1 according to the first exemplary embodiment. The explanation of the same components is omitted here for brevity.

The spark plug 1 according to the third exemplary embodiment has the same behavior and effects of the spark plug 1 according to the first exemplary embodiment.

While specific embodiments of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present disclosure which is to be given the full breadth of the following claims and all equivalents thereof.

What is claimed is:

1. A spark plug comprising:

a housing of a cylindrical shape comprising a housing stopper part projecting inwardly, a seat part which is a surface at a proximal end side of the housing stopper part, and a distal end cylindrical surface which is formed from a distal end side of the housing stopper part on an inner peripheral surface of the housing;

an insulator of a cylindrical shape supported by an inside of the housing, the insulator comprising an insulator stopper part mated with the housing stopper part on the seat part of the housing;

a central electrode arranged in and supported by an inside of the insulator so that a distal end part of the central electrode projects toward outside of the insulator; and a ground electrode connected to the housing, the ground electrode comprising a rod-shaped part and an extension part, the rod-shaped part extending toward a distal end side of the spark plug from the housing in a spark plug axial direction of the spark plug, the extension part being arranged facing the central electrode in the spark plug axial direction, and the extension part having a curved shape which is curved from the rod-shaped part inwardly in a radius direction of the spark plug, the central electrode and the extension part of the ground electrode forming a discharge gap, wherein the insulator further comprises at least one projection part, the at least one projection part is formed on an outer peripheral surface of the insulator at a location facing the distal end cylindrical surface in a radial direction of the spark plug so that the at least one projection part has a minimum distance measured from a plug central axis of the spark plug, which is longer than a distance of another part of the insulator measured from the plug central axis of the spark plug, on a cross section of the spark plug perpendicular to the plug central axis of the spark plug, the at least one projection part is formed on the outer peripheral surface of the insulator in a direction between the at least one projection part and the plug central axis of the spark plug which crosses to a direction between the rod-shaped part and the plug central axis of the spark plug; and the at least one projection part is aligned along the plug central axis, and is disposed on the outer peripheral of the insulator, in a space formed between the outer peripheral of the insulator and the distal end cylindrical surface.

2. The spark plug according to claim 1, wherein a cross section, in a direction perpendicular to the spark plug axial direction, of the outer peripheral surface of the insulator has a convex polygonal shape.

3. The spark plug according to claim 1, wherein the at least one projection part of the outer peripheral surface on a cross section in a direction which is perpendicular to the plug axial direction of the spark plug has a curved shape.

4. The spark plug according to claim 2, wherein the at least one projection part of the outer peripheral surface on a cross section in a direction which is perpendicular to the plug axial direction of the spark plug has a curved shape.

5. The spark plug according to claim 2, wherein the cross section, in the direction perpendicular to the spark plug axial direction, of the outer peripheral surface of the insulator has approximately a triangular shape as a convex polygonal shape.

6. The spark plug according to claim 5, wherein on a cross section of the outer peripheral surface of the insulator leg part, in a direction perpendicular to the spark plug axial direction, three corner parts of the triangular shape of the outer peripheral surface form three projection parts, and each of the three projection parts has a curved shape.

7. The spark plug according to claim 6, wherein two projection parts in the three projection parts are arranged at one side in a direction viewed from a virtual straight line, the virtual straight line connecting between the plug central axis and the rod-shaped part of the ground electrode, a remaining projection part in the three projection parts is arranged at the other side in the direction viewed from the virtual straight line, and the virtual straight line is located perpendicular to a straight line which connects between the plug central axis and the remaining projection part arranged at the other side in the direction Y.

8. The spark plug according to claim 2, wherein the cross section, in the direction perpendicular to the spark plug axial direction, of the outer peripheral surface of the insulator has approximately a pentagonal shape as a convex polygonal shape.

9. The spark plug according to claim 1, wherein a gap is formed between the at least one projection part and the distal end cylindrical surface, and a sectional area of the gap perpendicular to the plug central axis increases as the gap approaches the distal end of the spark plug.

10. The spark plug according to claim 1, wherein most of the at least one projection part, in the spark plug axial direction of the spark plug, faces the distal end cylindrical surface.

11. The spark plug according to claim 1, wherein a radially outermost portion of the at least one projection part is disposed in the space formed between the outer peripheral of the insulator and the distal end cylindrical surface.

12. A spark plug comprising:

a housing of a cylindrical shape comprising a housing stopper part projecting inwardly, and a seat part which is a surface at a proximal end side of the housing stopper part;

an insulator of a cylindrical shape supported by an inside of the housing, the insulator comprising an insulator stopper part mated with the housing stopper part on the seat part of the housing;

a central electrode arranged in and supported by an inside of the insulator so that a distal end part of the central electrode projects toward outside of the insulator; and a ground electrode connected to the housing, and the ground electrode comprising a rod-shaped part and an extension part, the rod-shaped part extending toward a distal end side of the spark plug from the housing in a spark plug axial direction of the spark plug, and the extension part being arranged facing the central electrode in the spark plug axial direction, and having a curved shape which is curved from the rod-shaped part inwardly in a radius direction of the spark plug, and the central electrode and the extension part of the ground electrode forming a discharge gap, wherein the insulator further comprises a distal end cylindrical surface and at least one of projection parts, the distal end cylindrical surface is formed from a distal end side of the housing stopper part on an inner peripheral surface of the housing, at least one of the projection parts is formed on an outer peripheral surface of the insulator at a location facing the distal end cylindrical surface in a radial direction of the spark plug so that at least one of the projection parts has a minimum distance measured from a plug central axis of the spark plug, which is longer than a distance of another part of the insulator measured from the plug central axis of the spark plug, on a cross section of the spark plug perpendicular to the plug central axis of the spark plug, at least one of the projection parts is formed on the outer peripheral surface of the insulator in a direction between at least one of the projection parts and the plug central axis of the spark plug which crosses to a direction between the rod-shaped part and the plug central axis of the spark plug, and a cross section, in a direction perpendicular to the spark plug axial direction, of the outer peripheral surface of the insulator has a convex polygonal shape.

13. The spark plug according to claim 12, wherein at least one of the projection parts of the outer peripheral surface on a cross section in a direction which is perpendicular to the plug axial direction of the spark plug has a curved shape.

14. The spark plug according to claim 12, wherein the cross section, in the direction perpendicular to the spark plug axial direction, of the outer peripheral surface of the insulator has approximately a triangular shape as a convex polygonal shape.

15. The spark plug according to claim 14, wherein on a cross section of the outer peripheral surface of the insulator leg part, in a direction perpendicular to the spark plug axial direction, three corner parts of the triangular shape of the outer peripheral surface form three projection parts, and each of the three projection parts has a curved shape.

16. The spark plug according to claim 15, wherein two projection parts in the three projection parts are arranged at one side in a direction viewed from a virtual straight line, the virtual straight line connecting between the plug central axis and the rod-shaped part of the ground electrode, a remaining projection part in the three projection parts is arranged at the other side in the direction viewed from the virtual straight line, and the virtual straight line is located perpendicular to a straight line which connects between the plug central axis and the remaining projection part arranged at the other side in the direction Y.

17. The spark plug according to claim 12, wherein the cross section, in the direction perpendicular to the spark plug axial direction, of the outer peripheral surface of the insulator has approximately a pentagonal shape as a convex polygonal shape.

* * * * *